US009667010B1

(12) United States Patent
Yu et al.

(10) Patent No.: US 9,667,010 B1
(45) Date of Patent: May 30, 2017

(54) CARBON BRUSH HOLDER

(71) Applicant: TAIWAN LONG HAWN ENTERPRISE CO., Taichung (TW)

(72) Inventors: Meng-Chiu Yu, Taichung (TW); Su-Chen Liao, Taichung (TW)

(73) Assignee: TAIWAN LONG HAWN ENTERPRISE CO., Taichung (TW)

( * ) Notice: Subject to any disclaimer, the term of this patent is extended or adjusted under 35 U.S.C. 154(b) by 0 days.

(21) Appl. No.: 14/960,652

(22) Filed: Dec. 7, 2015

(51) Int. Cl.
*H01R 39/00* (2006.01)
*H01R 39/38* (2006.01)
*H01R 39/26* (2006.01)

(52) U.S. Cl.
CPC ..... *H01R 39/381* (2013.01); *H01R 39/26* (2013.01)

(58) Field of Classification Search
CPC ..... H01R 39/381; H01R 39/26
USPC ..... 439/30
See application file for complete search history.

(56) References Cited

U.S. PATENT DOCUMENTS 8,836,198 B2 * 9/2014 Yu ..... H01R 39/385 310/242

* cited by examiner

*Primary Examiner* — Javaid Nasri
(74) *Attorney, Agent, or Firm* — Tracy M Heims; Apex Juris, Pllc

(57) ABSTRACT

A carbon brush holder is provided, which includes an insulating base, a metal brush frame, and two carbon brushes, wherein the insulating base includes a first base and two second bases correspondingly engaging with two matching portions of the first base respectively; the first base has a first slot having a straight section and two winding sections respectively connected to two ends of the straight section and each of the second bases has a second slot, and a protrusion is formed on a slot wall thereon. The metal brush frame includes a main frame and two branch frames respectively connected to two ends of the main frame, wherein the main frame is embedded in the first slot; the two branch frames are embedded in the two second slots, and are connected to two carbon brushes respectively, to thereby provide an improved contact between the two carbon brushes and a slip ring assembly.

8 Claims, 6 Drawing Sheets

CARBON BRUSH HOLDER

BACKGROUND OF THE INVENTION

1. Technical Field

The present invention relates generally to an electrical signal transmission member in an electro-mechanical system, and more particularly to a carbon brush holder.

2. Description of Related Art

In an electro-mechanical system, slip rings and carbon brush holders are commonly used for transmitting electric current or signals to and from rotary parts in the electro-mechanical system.

Generally, a slip ring assembly includes a plurality of conductive slip rings and a plurality of insulating rings, wherein each of the conductive slip rings is arranged between two of the insulating rings. As shown in FIG. 1 and FIG. 2, a conventional carbon brush holder 1 includes a metal brush frame 2 and two carbon brushes 3. The metal brush frame 2 is made of a metal sheet with high electrical conductivity, and is formed by a punching process. The metal brush frame 2 includes a main frame 2*a* and two branch frames 2*b* respectively connected to two ends of the main frame 2*a*. The two carbon brushes 3 are connected to the two branch frames 2*b* respectively to abut against a conductive slip ring (not shown) for steadily transmitting electric current or signals.

However, due to the results of the processing method and the finish manufacturing of the metal brush frame 2, an included angle θ between the main frame 2*a* and each of the two branch frames 2*b* is prone to being too large, which may leave a gap between the carbon brush 3 and the conductive slip ring. As a result, there may be interference with transmission of electric current or signals.

Moreover, each of the branch frames 2*b* should be positioned as depicted by the solid line in FIG. 2, but may swing to the position depicted by the dotted line in the same figure because of a lapse of the processing method. Consequently, the two carbon brushes 3 would either fail to precisely contact the conductive slip ring or abut against the insulating ring, which obstructs the transmission of electric current or signals. Such obstructions are particularly problematic for a miniaturized slip ring assembly, since it has a shorter interval between two adjacent insulating rings.

BRIEF SUMMARY OF THE INVENTION

In view of the above, the primary objective of the present invention is to provide a carbon brush holder, which has a good contact with a conductive ring of a slip ring assembly.

The present invention provides a carbon brush holder including an insulating base, a metal brush frame, and two carbon brushes. The insulating base has a first slot and two second slots arranged in two opposite sides of the first slot. The metal brush frame includes a main frame and two branch frames which are connected to two ends of the main frame respectively. The main frame is received in the first slot, and the two branch frames are received in the two second slots respectively. The two carbon brushes are connected to the two branch frames respectively.

Whereby, the two carbon brushes of the present invention have a good contact with a conductive ring of a slip ring assembly so as to transmit electric current or signals fluently.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
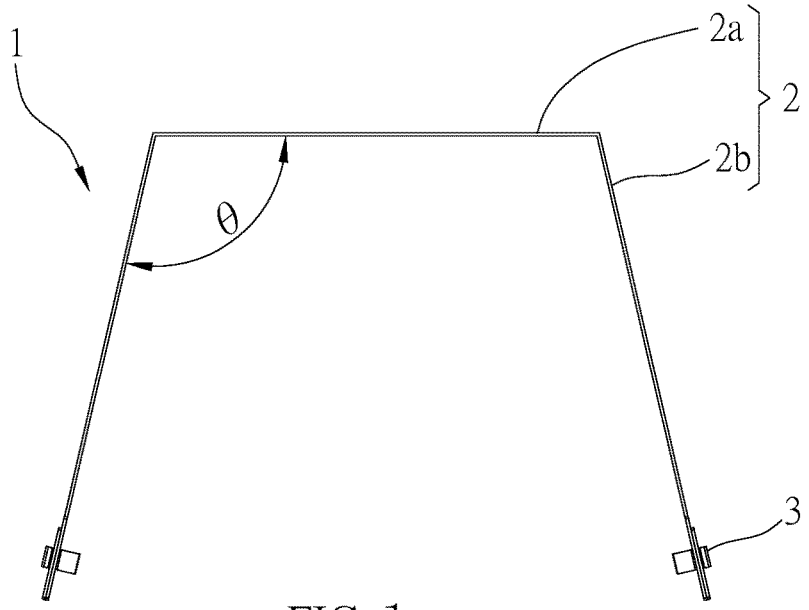
FIG. 1 (PRIOR ART)
FIG. 1 is a schematic diagram of the conventional carbon brush holder.
Figure 2:
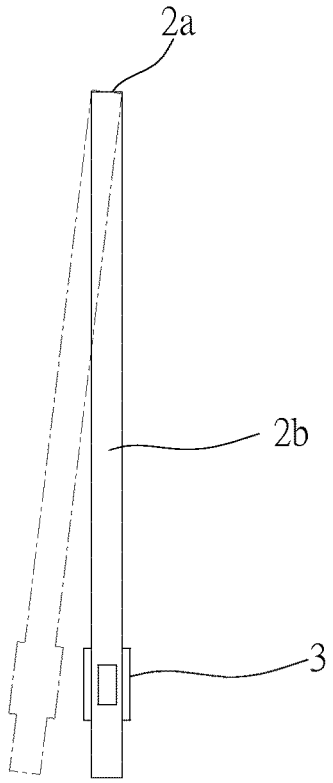
FIG. 2 (PRIOR ART)
FIG. 2 is a lateral view of the carbon brush holder in FIG. 1.
Figure 3:
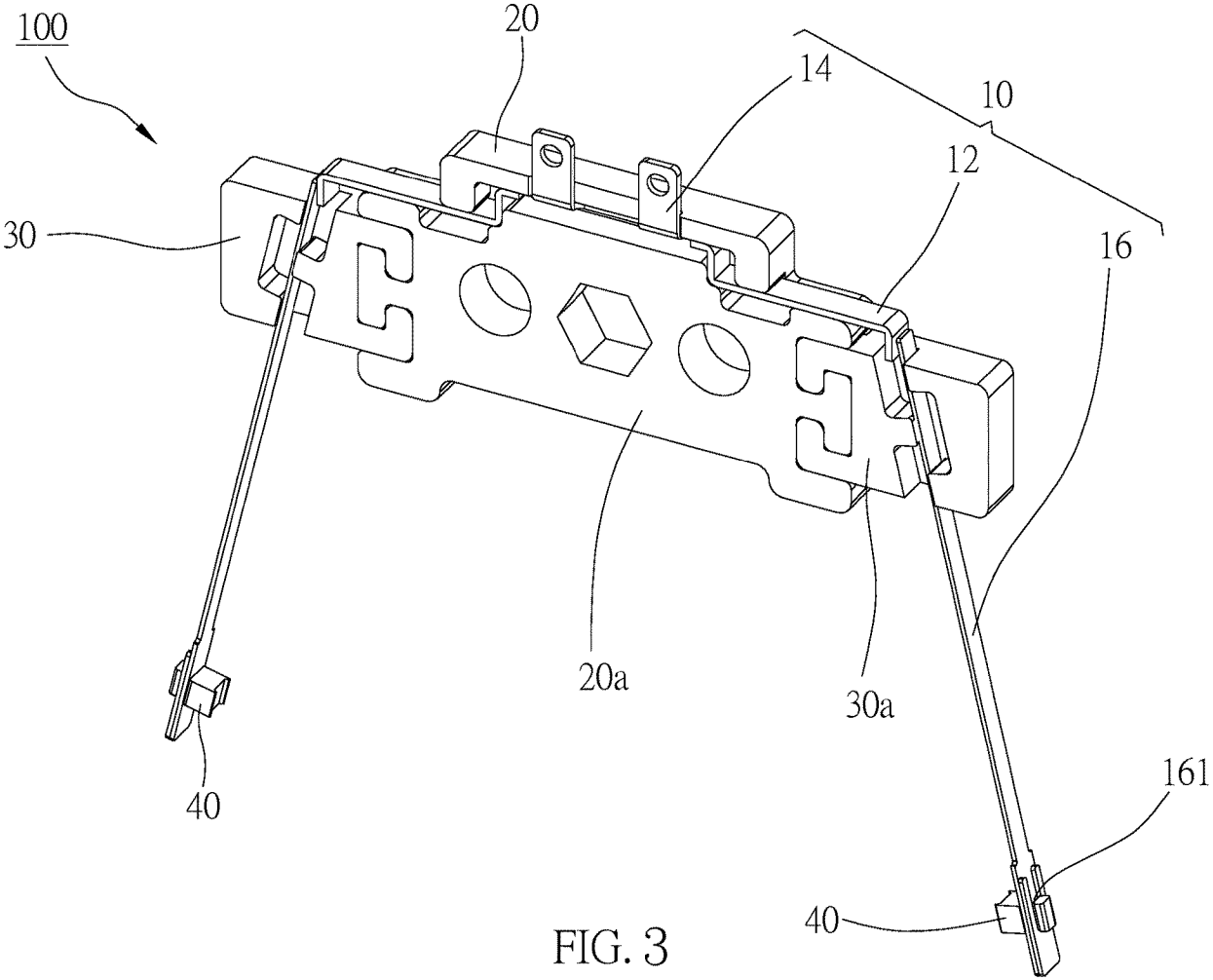
FIG. 3 is a perspective view of a preferred embodiment of the present invention, showing the carbon brush holder.
Figure 4:
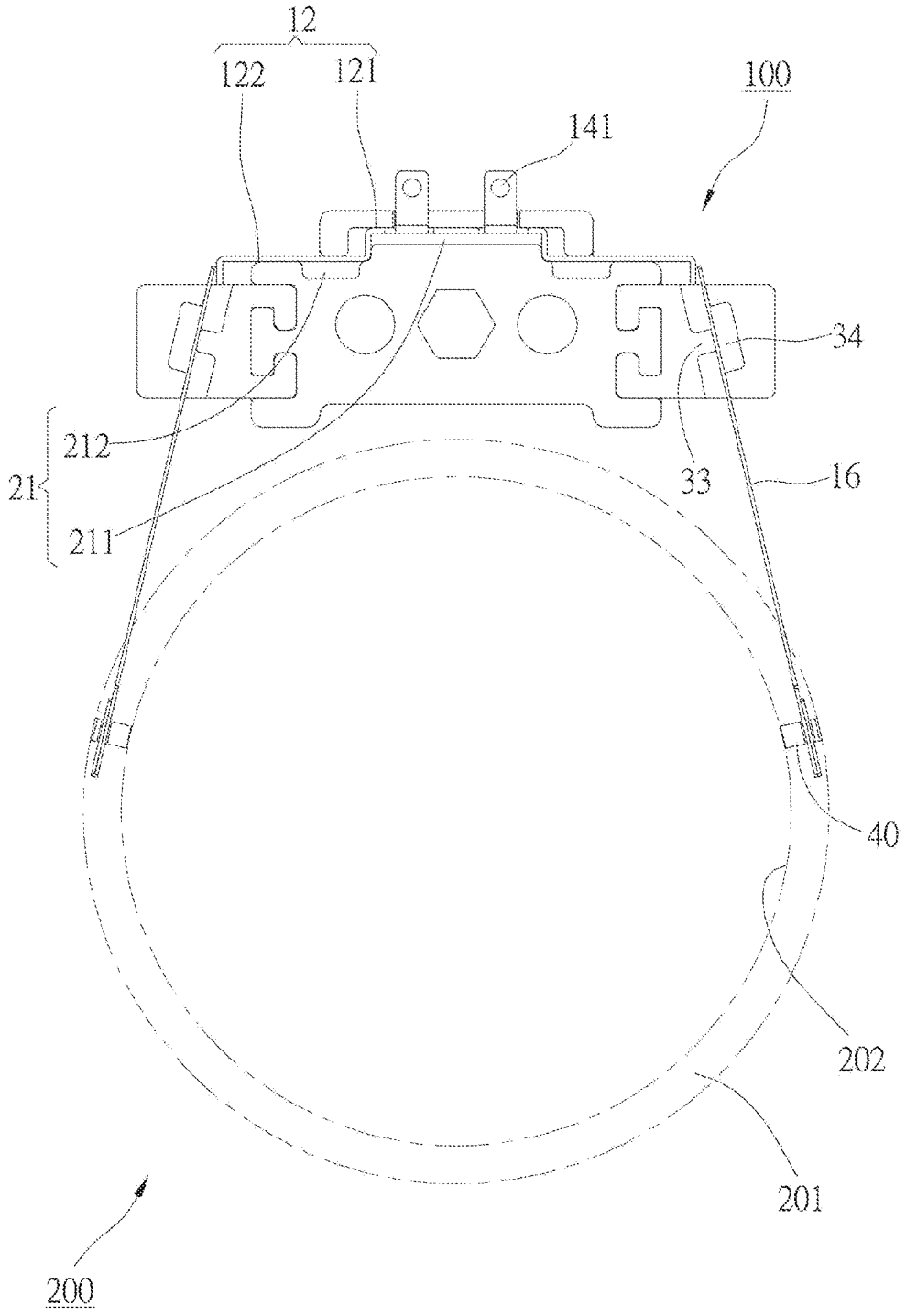
FIG. 4 is a schematic diagram of the carbon brush holder in FIG. 3, which is connected to the slip ring.

As shown in FIG. 3 to FIG. 4, a carbon brush holder 100 of the first preferred embodiment of the present invention is applied for a slip ring assembly 200, and includes a metal brush frame 10, an insulating base, and two carbon brushes 40 which are used in abutting against the slip ring assembly 200.

The metal brush frame 10 is made of conductive materials, and includes a main frame 12 and two branch frames 16 which are soldered to two ends of the main frame respectively. The main frame 12 is formed by stamping and bending, and has a first segment 121, two second segments 122, and a connecting portion 14, wherein the two second segments 122 are connected to two ends of the first segment 121. The connecting portion 14 is connected to the first segment 121, and also the middle part of the main frame 12. Additionally, the connecting portion 14 has an aperture 141 thereon to connect with a conducting wire (not shown). Each of the two branch frames 16 has an opening 161 to be engaged by one of the carbon brushes 40.

The assembly process of the metal brush frame 10 and the slip ring assembly 200 is as follows. Each of the branch frames 16 is supported by a fixture (not shown), and then is embedded in a circular groove 201 of the slip ring assembly 200 with an end engaged by the carbon brush 40 so that each of the carbon brushes 40 abuts against a conductive ring 202 of the slip ring assembly 200. Next, the main frame 12 is soldered to the other end of each of the branch frames 16 to fix the included angle between the main frame 12 and each of the branch frames 16. In this way, each of the carbon brushes 40 has a good contact with the conductive ring 202 under connecting to the metal brush frame 10 as shown in FIG. 4.

Figure 5:
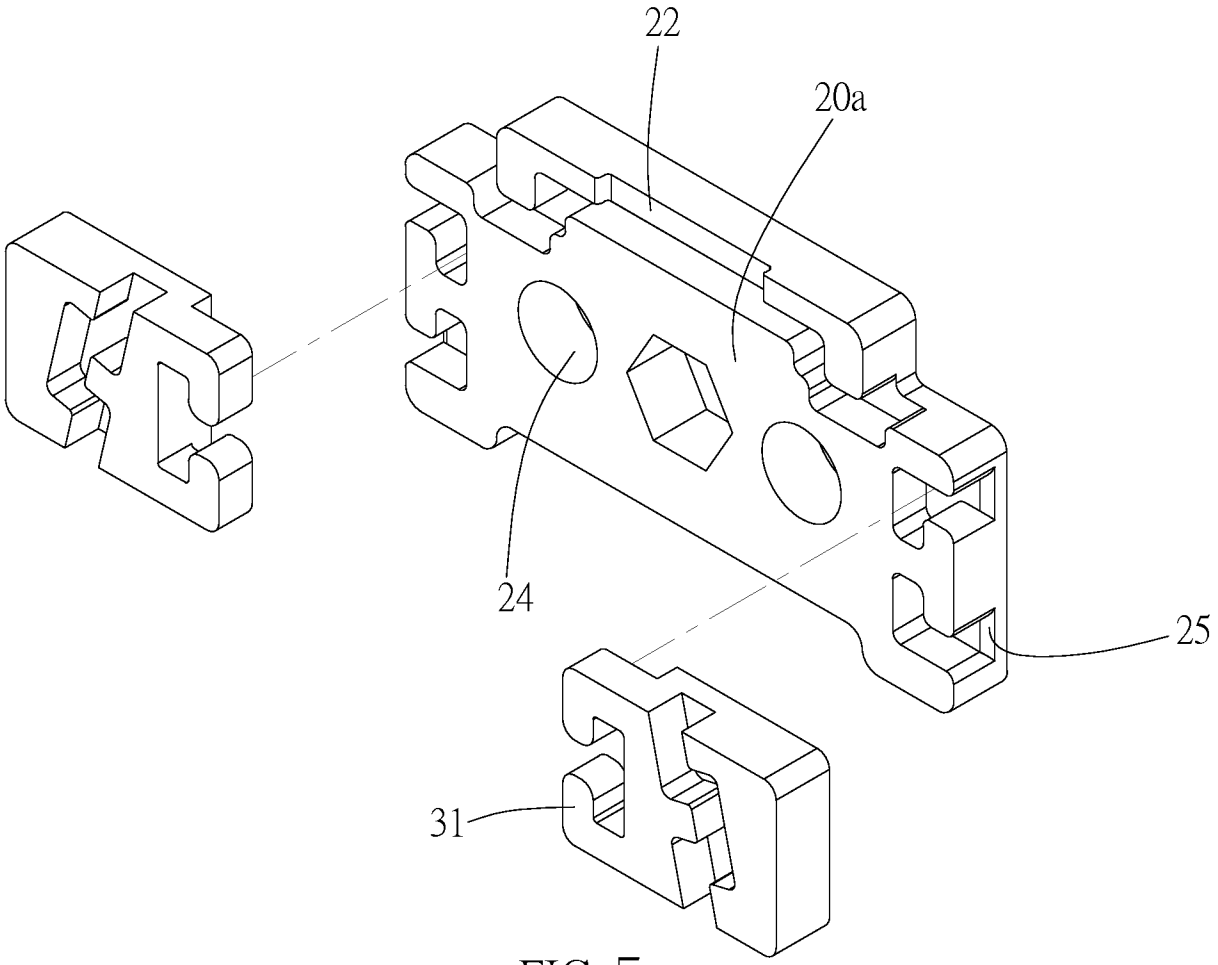
FIG. 5 is a exploded view of the insulating base in FIG. 3.
Figure 6:
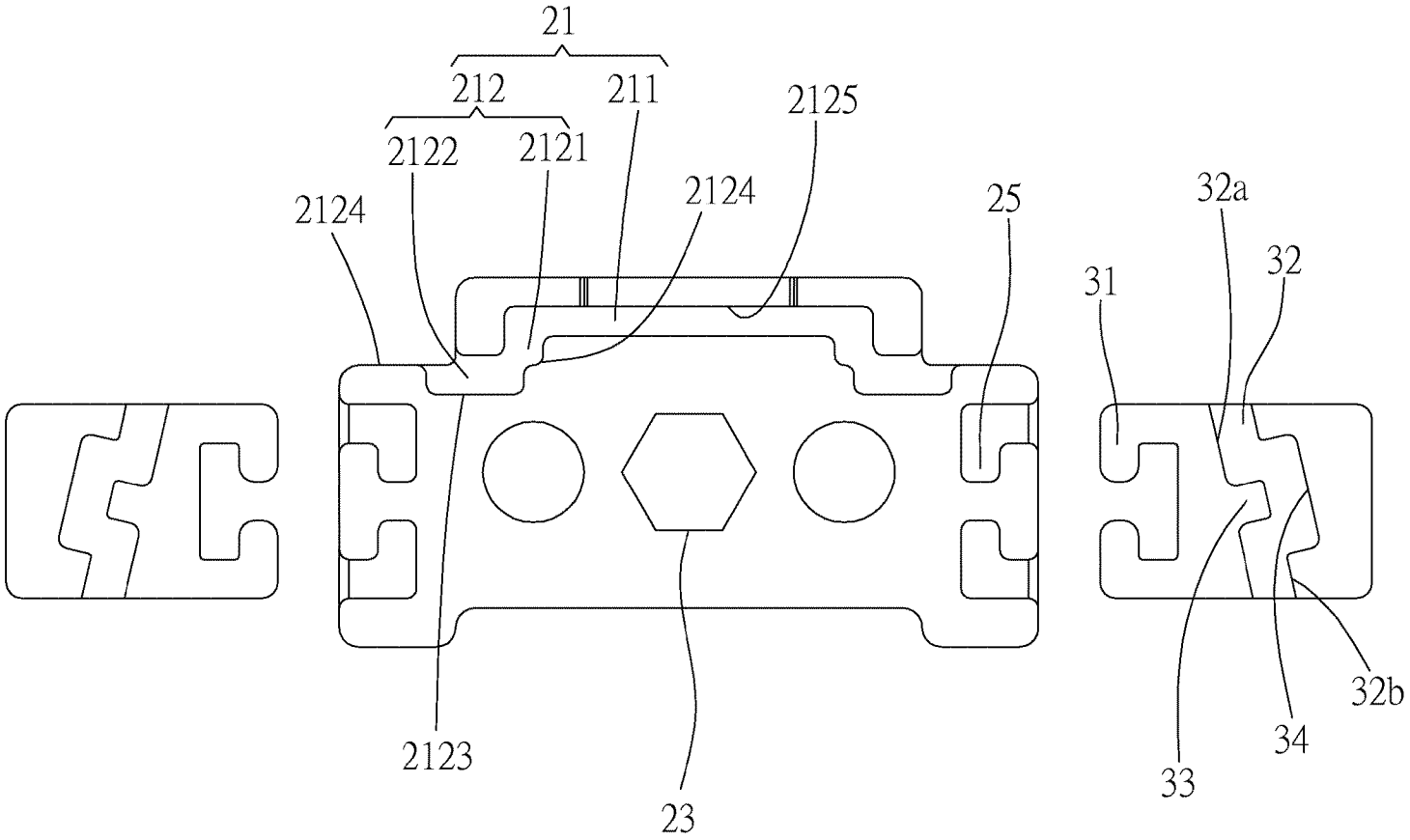
FIG. 6 is a front view of the insulating base in FIG. 3.

The insulating base is made of insulation materials. As illustrated in FIG. 3 to FIG. 5, the insulating base supports the metal brush frame 10, and includes a first base 20 and two second bases 30. The first base 20 has a first slot 21, a notch 22, a polygonal hole 23, and two holes 24, wherein the first base 20 has two matching portions, and each of the matching portions has two grooves 25. The main frame 12 is received in the first slot 21.

The first base 20 has a first surface 2125 and a second surface 2124 which face each other, wherein the first slot 21 is formed between the first surface 2125 and a part of the second surface 2124; the first slot 21 has a straight section 211 and two winding sections 212 which are respectively connected to two ends of the straight section 211, wherein a curve is formed at where the straight section 211 and each of the two winding sections 212 are connected. Each of the two winding sections 212 is divided into a first segment 2121 and a second segment 2122 by definition, which are substantially perpendicular to each other, wherein the first segment 2121 is connected to one of the two end of the straight section 211.

The first surface 2125 and the second surface 2124 of the first base 20 respectively abut against one of two opposite surfaces of the main frame 12 at least at the curves formed between the straight section 211 and the winding sections 212 of the first slot 21 so as to fix the main frame 12. In additional, in each of the second segments 2122, a recession 2123 is formed on the second surface 2124 of the first base 20, wherein the second surface 2124 abuts against one of the two opposite surfaces of the main frame 12 with portions thereof neighboring both sides of each of the recessions 2123.

The notch 22 communicates the straight section 211 of the first slot 21 and exterior of the insulating base. The connecting portion 14 is electrically connected to a conducting wire, and passing through the notch 22 with an end thereof exposed outside of the insulating base. The polygonal hole 23 and the two holes 24 pass through the first base 20, wherein the polygonal hole 23 is arranged between the two holes 24. In the preferred embodiment, the polygonal hole 23 is a hexagonal hole.

Each of the two second bases 30 has two extension blocks 31, a second slot 32, and a protrusion 33, wherein each of the extension blocks 31 has a complementary shape to the grooves 25 of one of the matching portions for engaging with the corresponding grooves 25. Therefore, the two second bases 30 are detachably connected to two matching portions of the first base 20 respectively. Each of the second slots 32 has two slot walls 32*a*, 32*b*, and each of the two branch frames 16 is received in the one of the two second slots 32. The protrusions is formed on one of the slot walls 32*a*, and abuts against a surface of one of the branch frames 16; the other slot wall 32*b* abuts against another surface of one of the two branch frames 16, wherein said another surface of each of the two branch frames is opposite to the surface which is abutted by the protrusions 33. Whereby, each of the branch frames 16 is fixed by one of the second bases 30.

In this embodiment, each of the second base 30 further has a recession 34, which is formed on the other slot wall 32*b*, and corresponds to one of the protrusions 33 across the relevant second slot 32. The slot wall 32*b* which has the recession 34 formed thereon abuts against said another surface of the branch frame 16 with portions thereof neighboring both sides of the relevant recession 34. The recession 34 provides a room for the branch frame 16 when the branch frame 16 is forced and deformed by the corresponding protrusion 33.

After the second bases 30 are connected to the first base 20, a surface 20*a* of the first base 20 and a surface 30*a* of the second bases 30 are formed as a same plane. When fabrication of the insulating base and the metal brush frame 10 is finished, the main frame 12 is embedded in the first slot 21, and is pressed by both the first surface 2125 and the second surface 2124; the two branch frames 16 are respectively embedded in the two second slots 32, and is abutted by both the protrusion 33 and the slot wall 32*b*.

Furthermore, as shown in FIG. 4, with the design of the two second bases 30, the two ends of the branch frames 16 connected to the two carbon brushes 40 are close to each other. In other words, the design makes the two carbon brushes 40 have a good contact with the conductive ring 202 of a slip ring assembly 200 to stably transmit electric current or signals.

Figure 7:
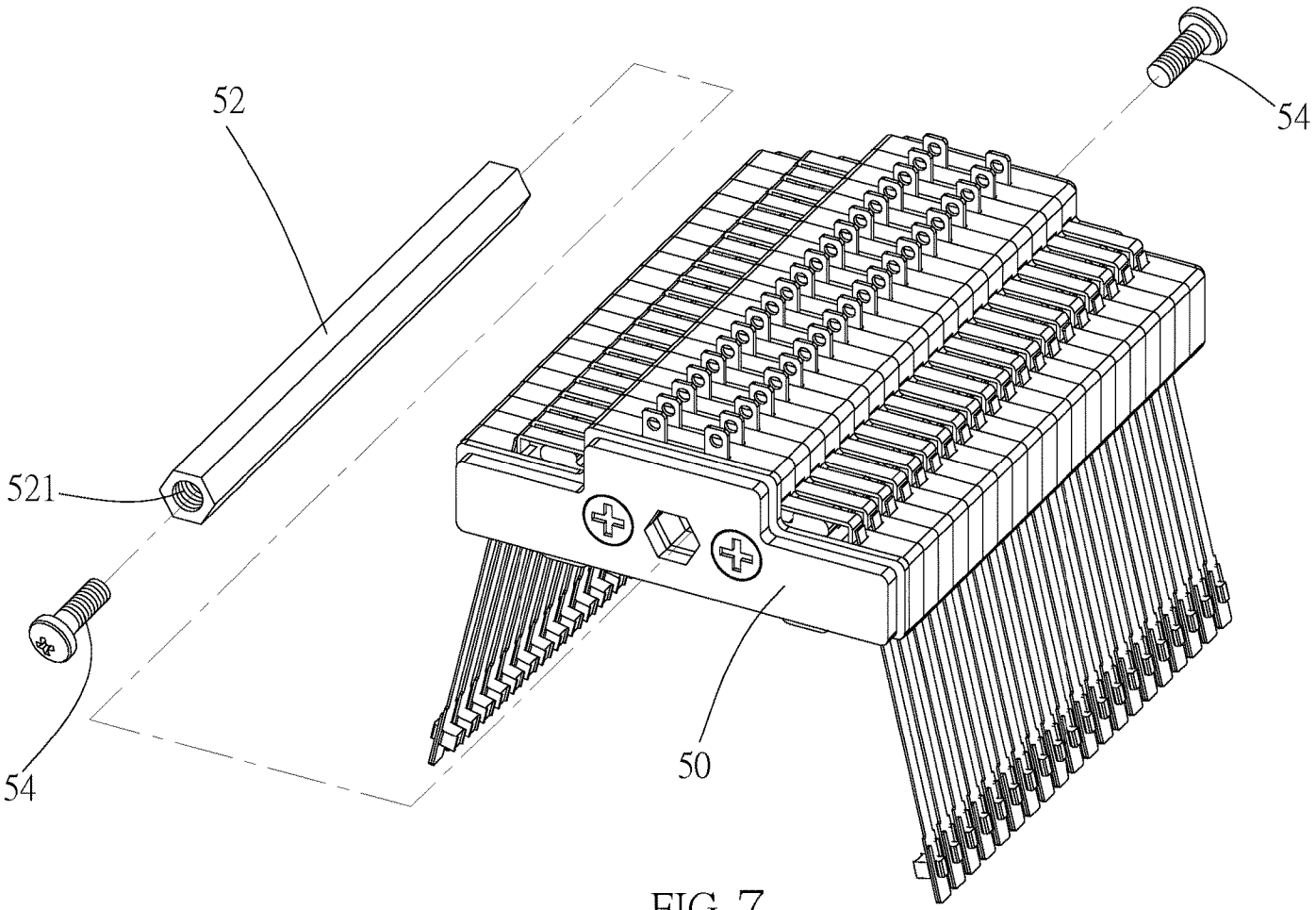
FIG. 7 is a perspective view of the preferred embodiment, showing the carbon brush holders in serial connection.

In additional, as illustrated in FIG. 7, the carbon brush holder 100 could be connected to one another in a stack through two splints 50, a polygonal column 52 which is a hexagonal column in the preferred embodiment, and two bolts 54. Two ends of the polygonal column 52 have two screw holes 521 respectively. After the polygonal column 52 passes through the two splints 50 and the polygonal holes 23 on the first bases 20 的 polygonal hole, the two bolts 54 are screwed to the two screw holes 521 respectively, which finishes the assembly of the carbon brush holders 100. Moreover, the complementary shapes of the polygonal column 52 and the polygonal holes would help to avoid each of the carbon brush holders 100 from rotating relative to one another.

It must be pointed out that the embodiments described above are only some preferred embodiments of the present invention. All equivalent structures which employ the concepts disclosed in this specification and the appended claims should fall within the scope of the present invention.

What is claimed is:

1. A carbon brush holder, comprising:

an insulating base which has a first slot and two second slots arranged in two opposite sides of the first slot;

a metal brush frame comprising a main frame and two branch frames which are connected to two ends of the main frame respectively, wherein the main frame is received in the first slot, and the two branch frames are received in the two second slots respectively; and two carbon brushes connected to the two branch frames respectively;

wherein the insulating base comprises a first base and two second bases, wherein the first base has the first surface and the second surface, wherein the first slot is formed therebetween; the two second bases are detachably connected to two matching portions of the first base respectively; each of the second bases has one of the second slots.

2. The carbon brush holder of claim 1, wherein the main frame is formed by stamping and bending; the insulating base has a first surface and a second surface which face each other, wherein the first slot is formed between the first surface and a part of the second surface; the first slot has a straight section and two winding sections which are respectively connected to two ends of the straight section, wherein a curve is formed at where the straight section and each of the two winding sections are connected; the first surface and the second surface of the insulating base respectively abut against one of two opposite surfaces of the main frame at least at the curves formed between the straight section and the winding sections of the first slot.

3. The carbon brush holder of claim 2, wherein each of the two winding sections is divided into a first segment and a second segment by definition, which are substantially perpendicular to each other, wherein the first segment is connected to one of the two end of the straight section; in each of the second segments, a recession is formed on the second surface of the insulating base, wherein the second surface of the insulating base abuts against one of the two opposite surfaces of the main frame with portions thereof neighboring both sides of each of the recessions.

4. The carbon brush holder of claim 1, wherein each of the second slots has two slot walls; the insulating base has two protrusions, each of which is formed on one of the slot walls of one of the second slots, and abuts against a surface of one of the branch frames; the other slot wall of each of the second slots abuts against another surface of one of the two branch frames, wherein said another surface of each of the two branch frames is opposite to the surface which is abutted by one of the protrusions.

5. The carbon brush holder of claim 4, wherein the insulating base has two recessions; each of which is formed on one of the slot walls of one of the second slots, and corresponds to one of the protrusions across the relevant second slot; the slot wall of each of the second slots which has one of the recessions formed thereon abuts against said another surface of one of the branch frames with portions thereof neighboring both sides of the relevant recession.

6. The carbon brush holder of claim 1, wherein the two branch frames are soldered to the two ends of the main frame respectively.

7. The carbon brush holder of claim 1, wherein the insulating base has a notch communicating the first slot and exterior of the insulating base; the main frame comprises a connecting portion to be electrically connected to a conducting wire, wherein the connecting portion passes through the notch with an end thereof exposed outside of the insulating base.

8. The carbon brush holder of claim 1, wherein each of the matching portions has two grooves, and each of the second bases has two extension blocks which have complementary shapes to the grooves of one of the matching portions; the extension blocks engage with the corresponding grooves.

* * * * *